US011162292B2

(12) United States Patent
Soderqvist

(10) Patent No.: US 11,162,292 B2
(45) Date of Patent: Nov. 2, 2021

(54) DOOR OPERATOR AND METHOD FOR SET-UP OF A DOOR OPERATOR

(71) Applicant: ASSA ABLOY ENTRANCE SYSTEMS AB, Landskrona (SE)

(72) Inventor: Sven-Gunnar Soderqvist, Vallakra (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 371 days.

(21) Appl. No.: 16/306,374

(22) PCT Filed: Jun. 12, 2017

(86) PCT No.: PCT/EP2017/064235
§ 371 (c)(1),
(2) Date: Nov. 30, 2018

(87) PCT Pub. No.: WO2017/220362
PCT Pub. Date: Dec. 28, 2017

(65) Prior Publication Data

US 2019/0301227 A1 Oct. 3, 2019

(30) Foreign Application Priority Data

Jun. 22, 2016 (SE) ..... 1630162-4

(51) Int. Cl.
*E05F 15/00* (2015.01)
*E05F 15/603* (2015.01)

(52) U.S. Cl.
CPC ..... *E05F 15/603* (2015.01); *E05Y 2400/40* (2013.01); *E05Y 2400/80* (2013.01); *E05Y 2400/85* (2013.01); *E05Y 2900/132* (2013.01)

(58) Field of Classification Search
CPC ..... E05F 15/611; E05F 15/00; E05F 15/603; E05F 15/70; E05F 15/77; E05Y 2400/80;
(Continued)

(56) References Cited

U.S. PATENT DOCUMENTS 5,453,736 A 9/1995 Noren
6,225,904 B1 * 5/2001 Jaffe ..... F25D 23/021 340/545.3

(Continued)

FOREIGN PATENT DOCUMENTS

WO 2013052630 4/2013
WO 2015175614 11/2015

OTHER PUBLICATIONS

International Search Report mailed in PCT/EP2017/064235 dated Sep. 7, 2017.
Swedish Search Report mailed in SE 1630162-4 dated Mar. 2, 2017.

*Primary Examiner* — Chi Q Nguyen
(74) *Attorney, Agent, or Firm* — Wissing Miller LLP

(57) ABSTRACT

A door operator for operating a door leaf of a door set includes a control unit, a drive unit and a user interface. The control unit detects that the door operator is in a first mode to receive a set of set-up parameters. In the first mode the control unit detects an external data storage, provides access to the external data storage, and automatically receives a set of set-up parameters from the external data storage. The door operator installs the set of set-up parameters in the control unit. The door operator controls the drive unit to operate the door leaf based on the set of set-up parameters.

20 Claims, 3 Drawing Sheets

(58) Field of Classification Search
CPC ..... E05Y 2400/852; E05Y 2400/00; E05Y 2900/132; E05Y 2400/30; E05Y 2400/456
USPC ..... 49/31, 13, 506; 340/5.7, 5.71
See application file for complete search history.

(56) References Cited

U.S. PATENT DOCUMENTS

| | | | | |
|---|---|---|---|---|
| 8,844,200 | B2 * | 9/2014 | Yulkowski | E05F 15/63 49/358 |
| 10,480,236 | B2 * | 11/2019 | Soderqvist | E05F 15/611 |
| 10,781,620 | B2 * | 9/2020 | Hucker | E05F 1/10 |
| 2008/0022596 | A1 * | 1/2008 | Boerger | G08B 5/36 49/31 |
| 2008/0236048 | A1 * | 10/2008 | Kowalczyk | E05F 3/224 49/280 |
| 2009/0093913 | A1 * | 4/2009 | Copeland, II | E05F 1/002 700/282 |
| 2009/0122534 | A1 * | 5/2009 | Olmsted | E05F 15/70 362/233 |
| 2010/0115853 | A1 | 5/2010 | Gebhart et al. | |
| 2012/0272576 | A1 | 11/2012 | Van Tassell, III et al. | |
| 2013/0009785 | A1 * | 1/2013 | Finn | G08B 7/06 340/870.01 |
| 2013/0127590 | A1 | 5/2013 | Braverman et al. | |
| 2013/0285584 | A1 * | 10/2013 | Kim | H02P 29/0241 318/400.21 |
| 2014/0125499 | A1 | 5/2014 | Cate et al. | |
| 2014/0259927 | A1 | 9/2014 | McNally, II | |
| 2015/0355828 | A1 * | 12/2015 | Kiyomasa | G06F 3/04817 715/771 |
| 2017/0124011 | A1 * | 5/2017 | Verdino | G06F 13/385 |
| 2017/0275938 | A1 * | 9/2017 | Langenberg | E05F 15/70 |

* cited by examiner

DOOR OPERATOR AND METHOD FOR SET-UP OF A DOOR OPERATOR

This application is a 371 of PCT/EP2017/064235 filed on Jun. 12, 2017, published on Dec. 28, 2017 under publication number WO 2017/220362, which claims priority benefits from Swedish Patent Application No. 1630162-4 filed Jun. 22, 2016, the disclosure of which is incorporated herein by reference.

FIELD OF THE INVENTION

The present invention relates to a door operator and a method for set-up of a door operator.

BACKGROUND OF THE INVENTION

Automatic door sets are regulated by standards such as the European standard EN16005 which defines, i.e., pedestrian protection requirements for door sets. These regulations define, e.g., maximum kinetic energy, maximum closing force, opening and closing time, opening and closing time for different parts of speed trajectory of a door and use of safety sensors. These regulations were created in order to minimise the risk of injuries to any individual located in the closing path of a door leaf during closing. Many of the parameters are dependent on the surroundings of the door operator and to the door leaf and thus each door operators have to be installed and set-up on site after the door set has been mounted.

SUMMARY OF THE INVENTION

It is an object of the present invention to mitigate the above problems, and to provide a solution for set-up of a door operator on site in a more efficient way.

According to a first aspect of the present invention, these objects are achieved by a door operator for operating a door leaf of a door set comprising a control unit, a drive unit and a user interface. The control unit is adapted to detect a first mode of receiving a set of set-up parameters, in the first mode, detect an external data storage, provide access to the external data storage, and automatically receive, in response to the detecting, a set of set-up parameters from the external data storage, install the set of set-up parameters in the control unit and control the drive unit based on the set of set-up parameters installed in the control unit.

By using the door operator according to the above, the time spent to install the set-up parameters could be reduced. By automating parts of the installation of the set-up parameters, the risk of human errors is also reduced. Further, by the door operator being able to interact with the external data storage, there is no need of an external computer to install the set-up parameters automatically.

According to one aspect, the control unit is adapted to detect a second mode of receiving the set of set-up parameters and could in the second mode be adapted to receive the set of set-up parameters provided via the user interface. By using the door operator according to the, the installation of the set-up parameters could either be done manually via the user interface as in the second mode or as in the first mode according to the above.

According to one aspect, the control unit could be connected to the drive unit and the user interface, and the drive unit comprises a motor and is adapted to be connected to the door leaf and to move it between an open and a closed position.

According to one aspect, the set of set-up parameters could comprise parameters that are dependent on the surroundings of the door leaf.

According to one aspect, the set of set-up parameters could comprise at least one of the parameters of the geometry of the door set, the geometry of the door leaf, the speed trajectory of the door leaf, a virtual spring, a power assist, a motor lock and a lock release.

According to one aspect, the control unit could comprise a memory unit and wherein the memory unit is configured to store said set of set-up parameters.

According to one aspect, the control unit could be configured to authenticate the set of set-up parameters.

According to one aspect, the door operator could comprise a Universal Serial Bus port. The Universal Serial Bus port could be connected to the control unit and adapted to be connected to an external data storage in the form of an external Universal Serial Bus memory.

According to one aspect, the door operator could comprise a wireless communication device. The wireless communication device could be connected to the control unit and adapted to establish a wireless communication with an external wireless communication device.

According to one aspect, the control unit could be adapted to detect a third mode of transferring the set of set-up parameters and in the third mode: detect an external data storage, provide access to the external data storage, and transfer, in response to input from the user interface, the set of set-up parameters to the external data storage.

According to one aspect, the user interface could comprise a touch screen, a potentiometer, a dip switch and/or a set of buttons.

According to a second aspect of the present invention, these objects are achieved by a method for set-up of a door operator for operating a door leaf of a door set, the door operator comprises a control unit, a user interface and a drive unit, wherein the control unit is connected to the drive unit and the user interface, and the drive unit comprises a motor and is adapted to be connected to the door leaf and to move it between an open and a closed position, wherein the method comprises the steps of detecting a first mode of receiving a set of set-up parameters, in the first mode detecting an external data storage, provide access to the external data storage, and automatically receive, in response to the detecting, a set of set-up parameters from the external data storage, installing the set of set-up parameters in the control unit and controlling the drive unit based on the set of set-up parameters installed in the control unit.

According to one aspect, the method further comprises the steps of detecting a second mode of receiving the set of set-up parameters and in the second mode receiving the set of set-up parameters could be provided via the user interface.

According to one aspect, the second mode could further comprise the step of authenticating the set of set-up parameters.

According to one aspect, the method could comprise the step of storing the set of set-up parameters on a memory unit in the control unit.

According to one aspect, the door operator could comprise a Universal Serial Bus port connected to the control unit, and wherein the step of detecting an external data storage comprise the step of detecting a Universal Serial Bus memory's connected to the Universal Serial Bus port.

According to one aspect, the door operator could comprise a wireless communication device and wherein the step of detecting an external data storage comprises the step of detecting an external wireless communication device connected to an external data storage.

According to one aspect, the set of set-up parameters could comprise at least one of the parameters of the geometry of the door set, the geometry of the door leaf, the speed trajectory of the door leaf, a virtual spring, a power assist, a motor lock and a lock release.

According to one aspect, method could comprise the step of detecting a third mode of transferring the set of set-up parameters: in the third mode: detecting an external data storage, providing access to the external data storage, and transferring, in response to input from the user interface (8), the set of set-up parameters to the external data storage.

According to one aspect, the detecting of the first, second and/or third mode could comprise the step of receiving input regarding the first, second or third mode provided via the user interface.

By using the method and door operator according to the above, the time spend to install the door operator could be reduced. By automating parts of the installation the risk of human errors are also reduced.

Generally, all terms used in the claims are to be interpreted according to their ordinary meaning in the technical field, unless explicitly defined otherwise herein. All references to "a/an/the [element, device, component, means, etc.]" are to be interpreted openly as referring to at least one instance of said element, device, component, means, etc., unless explicitly stated otherwise. Further, by the term "comprising" it is meant "comprising but not limited to" throughout the application.

BRIEF DESCRIPTION OF THE DRAWINGS

This and other aspects of the present invention will now be described in more detail, with reference to the appended drawings showing currently preferred embodiments of the invention.

DETAILED DESCRIPTION

Aspects of the present disclosure will be described more fully hereinafter with reference to the accompanying figures. The assembly and method disclosed herein can, however, be realized in many different forms and should not be construed as being limited to the aspects set forth herein.

The terminology used herein is for the purpose of describing particular aspects of the disclosure only, and is not intended to limit the disclosure. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

The present invention relates to door operators for different types of door sets and door leafs. More specifically, the invention relates to door operators for a swing door set, a revolving door set and a sliding door set.

In FIGS. 1 to 4 a door operator 1 is disclosed that is connected to a door leaf 2 of a swing door set 3 and adapted to move the door leaf 2 from an open position O to a closed position C and from a closed position C to an open position O.

Figure 5:
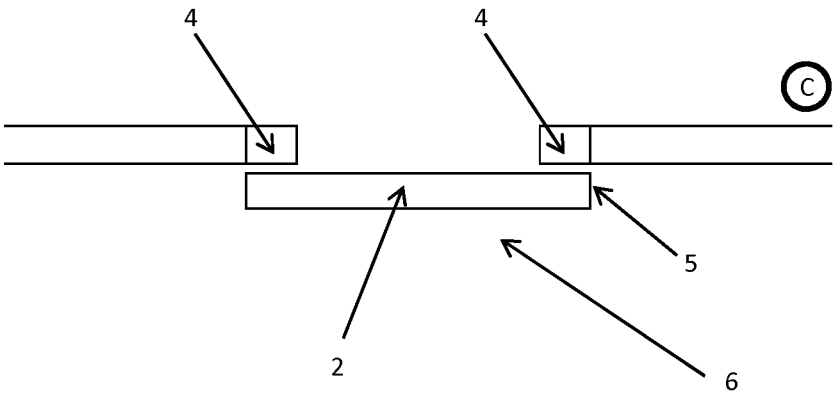
FIG. 5 shows a schematic top view of a sliding door with one door leaf, wherein the door leaf is arranged in a closed position.
Figure 6:
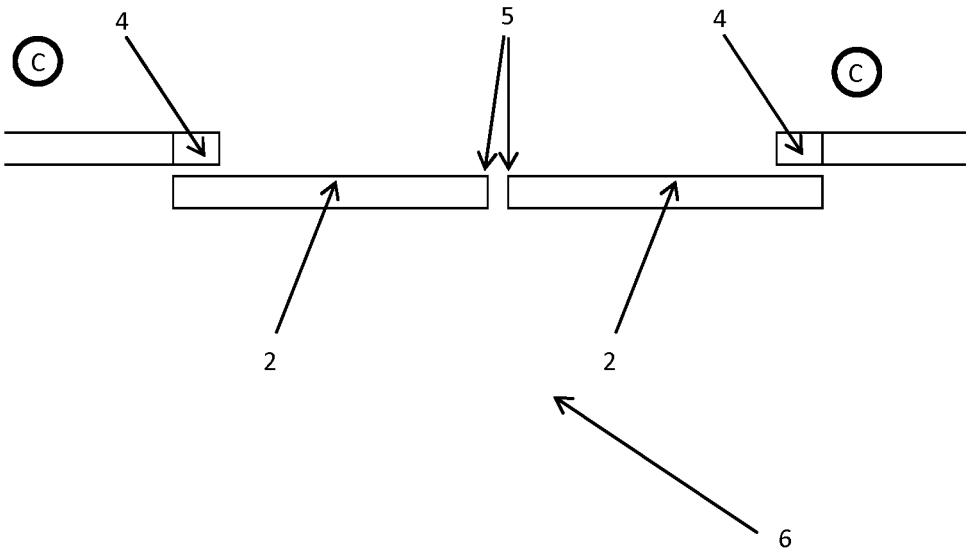
FIG. 6 shows a schematic top view of a sliding door with two door leafs, wherein the two door leafs are arranged in a closed position.

In FIGS. 5 and 6 a sliding door set 6 is disclosed that is adapted to be connected to a door operator 1.

A revolving door set generally refers to a door set having one or more door leafs that rotate about an axel.

A swing door set generally refers to a door set having one or two door leafs 2, i.e. a single leaf swing door set 3 or a double leaf swing door set 3, where each swing door leaf is hinged or pivoted to the door frame at one of its edges.

When the swing door set 3 is provided with only one door leaf 2, the swing door leaf 1 is hinged or pivoted at one edge to the door frame 4, while the main opening/closing edge 5 of the door leaf 2 closes against, and preferably locks with, the corresponding edge of the door frame 4.

When the swing door set 3 is provided with two swing door leaves 2, the swing door set 3 may comprise two identical swing door leafs 2*a, b*, arranged side by side with their respective opening/closing edges 3 in close proximity to each other when both door leafs 2 *a, b* are in the closed position C.

Also, the swing door set 3 may comprise a master swing door leaf 2*a*, provided with a flange extending along its main opening/closing edge 3, and a slave door leaf 2*b*. The flange of the master door leaf 2*a* is adapted to protrude over the main opening/closing edge 3 of the slave door leaf 2*b*, when both door leafs 2*a*, 2*b* are in the closed position C. With such an arrangement, the door leafs 2 *a*, 2*b* can be pushed open in one direction only, preferably from the inside of a room or building in a direction outwards towards the exterior, a corridor, or an evacuation route. The main opening/closing edge 3 of the master door leaf 2*a* closes against, and preferably locks into, an opposing opening/closing edge, i.e. the main opening/closing edge 5, of the slave door leaf 2*b*.

Correspondingly, a sliding door set 6 generally refers to a sliding door set 6 having one or two door leafs 2, i.e. a single leaf sliding door set or a double leaf sliding door set, where each door leaf 2 hangs from, and slides along, a rail arranged in parallel with the upper horizontal edge of the door frame 4. Each sliding door leaf 2 has a main opening/closing edge 5, whose distance from an opposing edge, which refers to either an edge formed by the main opening/closing edge 3 of a counter closing door leaf 2, or a fixed edge or a surface towards which the door leaf 2 is moving, such as a door frame 4, determines the usable opening of the sliding door set 6.

When the sliding door set 6 is provided with only one door leaf 2, the main opening/closing edge 5 of the door leaf 2 closes against, and preferably locks with, an edge of the door frame 2.

When the sliding door set 6 is provided with two sliding door leafs 2*a*, 2*b*, the main opening/closing edge 3 of the first door leaf 2*a* closes against, and preferably locks with, the corresponding edge of a second door leaf 2*b*.

In a swing door set 3, the open position O means that the door leaf 2 is opened to an angle α of approximately 80-110° in relation to the surrounding walls, which is a common door opening angle during regular use. The closed position C means that the swing door leaf is arranged at a 0° angle, i.e. the door opening is completely closed by the door leaf 2.

In a sliding door set 6, the open position O means that the door leaf 2 is arranged in one of its end positions, i.e. the end position wherein the door opening is open. The closed position C means that the opening/closing edge 5 of the door leaf 2 is arranged at the edge which it closes against, i.e. the door opening is completely closed. By "edge" is meant one side of a door frame or the opening/closing edge of a further sliding door leaf 2.

Figure 1:
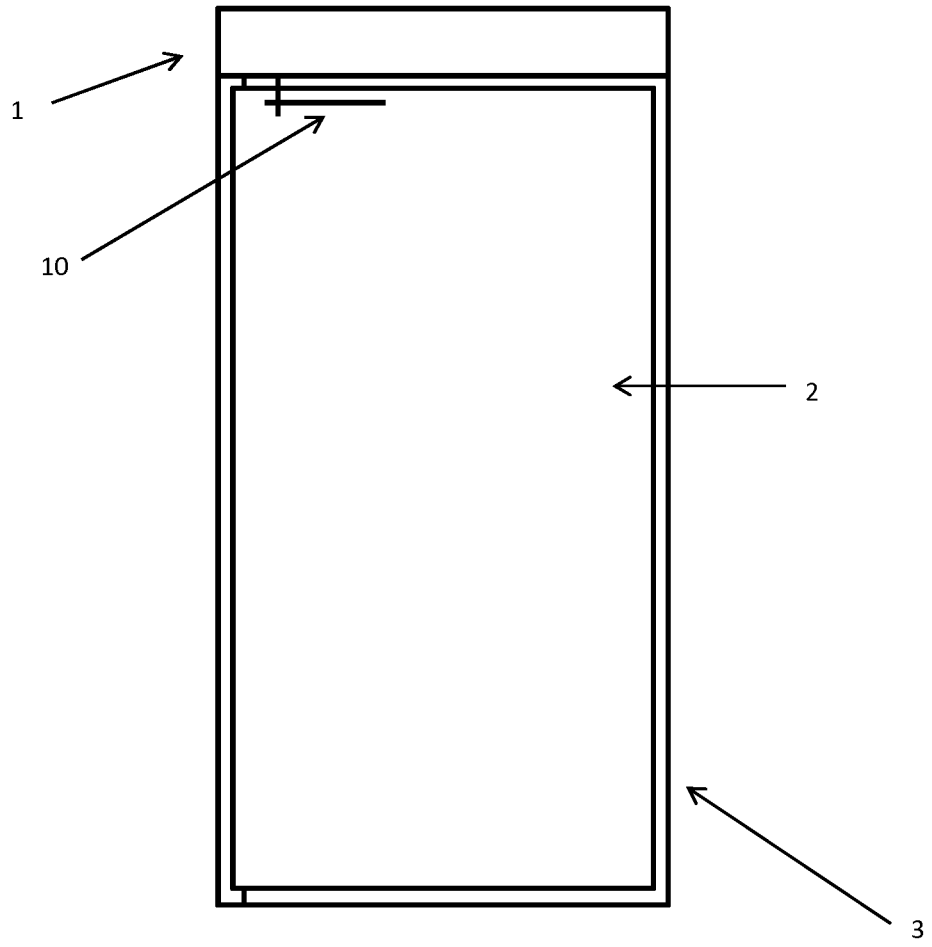
FIG. 1 discloses a door operator connected to a swing door.

A sliding door set 6 comprises at least one door leaf 2 and at least one door operator 1. The sliding door set 6 preferably comprises of one of the following combinations: one door leaf 2 and one door operator 1, as shown in FIGS. 1 and 5, two sliding door leafs 2*a, b* and one door operator 1, operating both sliding door leaves 2*a, b*, or two sliding door leafs 2*a, b* and two door operators 1, each sliding door leaf 2*a, b* being connected to its own door operator 1. Embodiments comprising two sliding door leafs 2*a, b* are shown in FIG. 6.

Figure 4:
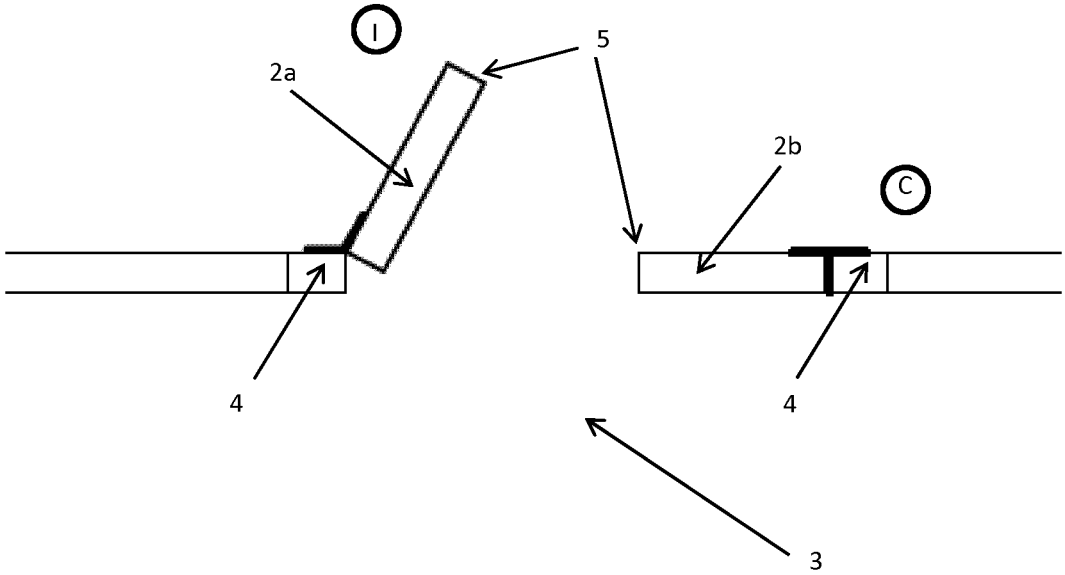
FIG. 4 shows a schematic top view of a swing door with two door leafs, wherein one door leaf is arranged in an intermediate position and one door leaf is arranged in a closed position.

A swing door set 3 comprises of at least one door leaf 2 and at least one door operator 1. The swing door set 3 preferably comprises of one of the following combinations: one door leaf 2 and one door operator 1, as shown in FIG. 1, or two swing door leafs 2*a*, 1*b* and two door operators 1, each door leaf 2*a*, 2*b* being connected to its own door operator 1, as shown in FIG. 4.

The door operator 1 is connected to the door leaf 2 and moves the door leaf 2 from its open position O to its closed position C and from its closed position C to its open position O.

Figure 2:
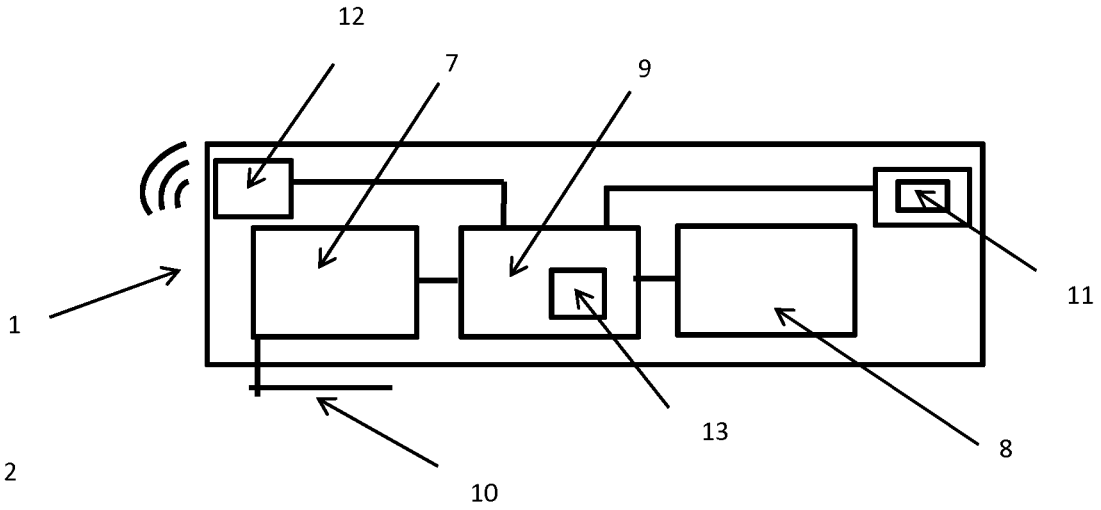
FIG. 2 disclose a schematic view of a door operator.
Figure 3:
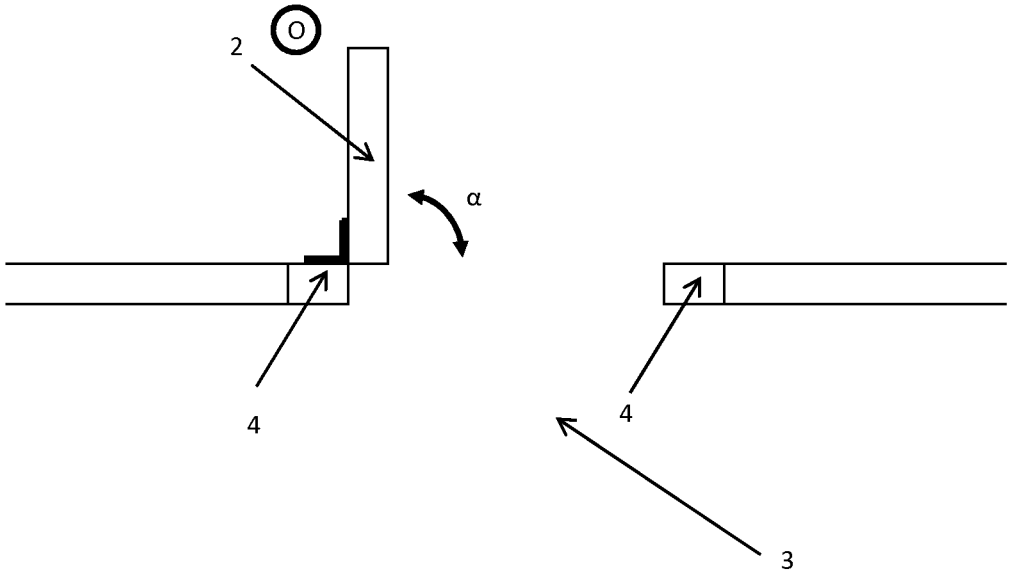
FIG. 3 shows a schematic top view of a swing door with one door leaf, wherein the door leaf is arranged in an open position.

In FIGS. 1 and 2 a door operator 1 is disclosed that comprise a drive unit 7, a user interface 8 and a control unit 9. The door operator 1 is connected to a door leaf 2 of a swing door set 3 and adapted to move the door leaf 2 from an open position O to a closed position C and from a closed position C to an open position O. The door operator further comprise a data port 11, a wireless communication device 13.

The drive unit 7 comprises a motor. The drive unit 7 can also comprise a gear box, one or more cams and cam functions and one or more springs and spring functions. The drive unit 7 is connected to the control unit 9. The drive unit 7 is connected to a power source and the value of the current applied to the drive unit 7 from the power source is controlled by the control unit 9. The drive unit 7 is connected to the door leaf 2 by a lever 10. The drive unit 7 is connected to one end of the lever 10 and the door leaf 2 is connected to a second end of the lever 10. The type of connection between the drive unit 7 and the door leaf 2 is dependent on the type of the door set 3, 6 and the door operator 1 and is well known in the art of door operators 1. Thus, the specific features of the connection between the door operator 1 and the door leaf 2 is not described in detail in this application.

The drive unit 7 accelerates when a positive current is applied to the motor. The drive unit 7 is braked when a negative current is applied to the motor. However, the drive unit 7 can also be installed such that is accelerated when a negative current is applied to the motor and braked when a positive current is applied to the motor. The drive unit 7 moves the door leaf 2 in relation to the current that is applied to the drive unit 7.

The user interface 8 is connected to the control unit 9 and configured to send input received at the user interface 8 to the control unit 9. An input that can be received via the user interface is parameters of the first speed trajectory or input of a first or a second mode of set-up of the control unit 9. The user interface 8 can comprise a display and be configured to receive input from the control unit 9 and to display the input. The user interface 8 can comprise switches, a touch screen, dip switches, potentiometers, buttons, a data port such as a USB-port or any combination thereof. The user interface 8 can according to an aspect be connected to the control unit 9 via a wireless connection. The user interface 8 can according to one aspect be remote from the control unit 9. The detecting of a first or a second mode of set-up of the control unit 9 can also be made by other means of the door operator 1 such as via information received from the wireless connection.

The control unit 9 is connected to the user interface 8 and the drive unit 7. The control unit 9 comprises a memory unit 13 and a central processing unit. The control unit 9 is configured to control the applied current to the drive unit 7. The control unit 9 is configured to control the value of the current applied to the drive unit 7. The control unit 9 is configured to control the value of the current applied at different times during the first speed trajectory to the drive unit 7. The control unit 9 is configured to receive information and data received at the user interface 8. The control unit 9 is connected to a data port 11 and to a wireless communication device 12.

The control unit 9 as such is well known in the art of door operators 1. Thus, the specific features of the connection between the control unit 9, the drive unit 7 and the user interface 8 are not described in detail in this application.

The data port 11 is connected to the control unit 9. The data port 11 is adapted to be connected to an external device and exchange data via the data port 11. According to one aspect, the data port 11 is a Universal Serial Bus port 11. The Universal Serial Bus port 11 could be connected to an external Universal Serial Bus memory. When a data plug is inserted in the data port 11, the data plug is detected and information of the detected data plug is sent to the control unit 9.

The wireless communication device 12 is connected to the control unit 9. The wireless connection is configured to send and receive electronic signals. The wireless communication device 12 could be configured to send and receive electronic signals via Bluetooth™, WiFi, Infrared or any kind of near field communication technology.

The door operator 1 employs a first speed trajectory to the door leaf 2 when opening and closing the door leaf 2. The first speed trajectory are set by a number of parameters in the door operator 1 and defines how the door operator 1 moves the door leaf 2, how much and when it is accelerated, how much and when it is braked, how long time it should take to open the door leaf 2, how long time it should take to close the door leaf 2 and the angle α that the door leaf 2 should be opened to. The door operator 1 is also set-up in relation to how it should be operated in case of an emergency such as a fire. The door operator 1 is also set-up in relation to different types of systems in the building that it is mounted in.

When the door operator 1 is installed in a building there are a number of parameters that are installed in the door operator 1 in the factory when building the door operator 1, however, there are also a number of the above number of parameters that needs to be set on site when the door operator 1 are installed. The parameters that are to be set in the door operator 1 on site are defined as a set of set-up parameters. The set-up parameters are dependent of the surroundings and location at which the specific door operator 1 is installed and to the specific door leaf 2 to which it is connected. The set of set-up parameters that are dependent on the surroundings and location is set during the installation of the door operator 1 on site.

The set of set-up parameters are stored in the door operator 1. According to one aspect the set of set-up parameters are stored in the memory 13 of the control unit 9.

When a number of door sets 3, 6 are mounted and installed in a building, many of the door operators 1 are installed and set-up with the same set of set-up parameters. This is for instance the case if a number of door sets 3, 6 are mounted in the same corridor with the same type of door operator 1 and door leaf 2 or if the same type of door operator 1 and door leaf 2 are mounted in the same position on different floors.

One of the set-up parameters that are set on site are the period/value of the time that it should take for the door operator 1 to move the door leaf 2 from its open position O to its closed position C and from its closed position C to its open position O.

The set of set-up parameters comprise at least one of the parameters of the geometry of the door set 3, 6, the geometry of the door leaf 2, the speed trajectory of the door leaf 2, a virtual spring, a power assist, a motor lock and a lock release.

The control unit 9 is adapted to detect a first or a second mode of receiving a set of set-up parameters. In the first mode it is configured to detect an external data storage, provide access to the external data storage, and automatically receive, in response to the detecting, the set of set-up parameters from the external data storage. The control unit 9 is also configured to install the set of set-up parameters in the control unit 9 and control the drive unit 7 based on the set of set-up parameters installed in the control unit 9.

In the second mode the control unit 9 is adapted to receive the set of set-up parameters provided via the user interface 8. The set of set-up parameters comprise parameters that are dependent on the surroundings of the door leaf 2.

According to one aspect, the control unit 9 is adapted to detect a third mode of transferring the set of set-up parameters. In the third mode the control unit 9 is configured to detect an external data storage, provide access to the external data storage, and transfer, in response to input from the user interface 8, the set of set-up parameters to the external data storage. By doing this the set of set-up parameters set in the door operator could be transferred to another door operator 1 needing a similar or identical set of set-up parameters. This reduces the time needed for set-up of the second door operator.

According to one aspect, the control unit 9 comprise a memory unit 13 and the memory unit 13 is configured to store said set of set-up parameters.

According to one aspect, the control unit 9 is configured to authenticate the set of set-up parameters. By authenticating the set of set-up parameters the control unit 9 can get information that the set of set-up parameters comes from a correct source and are valid for the door operator 1. If the set of set-up parameters not are authenticated by the control unit 9, the set-up of the control unit 9 will be interrupted.

According to one aspect, the wireless communication device 12 is connected to the control unit 9 and adapted to establish a wireless communication with an external wireless communication device.

After that the door set 3, 6 have been mounted in its position, it needs to be installed and the set of set-up parameters will be installed in the door operator. Hereafter the method of installation of a number of door sets comprising a door operator 1 and the method for set-up of a door operator 1 for operating a door leaf 2 of a door set 3, 6 will be described.

When a first door operator 1 should be installed, the door operator 1 detects the second mode of receiving the set of set-up parameters. The second mode could according to one aspect be detected by input received from the user interface 8. The input could come from the installing engineer interacting with the user interface 8. Thereafter the set of set-up parameters are provided via the user interface 8. The provided set of set-up parameters is installed in the control unit 9. The control unit 9 are now ready to control the drive unit 7 based on the set of set-up parameters installed in the control unit 9. The first door operator 1 is now installed.

When a second door operator 1 should be installed and if the second door operator 1 is mounted in such a position that it can use the same set of set-up parameters as the first door operator 1, the set of set-up parameters from the first door operator could be installed in the second door operator. This could for instance be due to that the door operators 1 are mounted in the same corridor and connected to the same type of door leaf 2.

The first door operator 1 now detects the third mode of transferring the set of set-up parameters. The third mode could according to one aspect be detected by input received from the user interface 8. The input could come from the installing engineer interacting with the user interface 8. According to one aspect, the third mode is detected by a data plug connected to an external memory is inserted into the data port 11. According to one aspect, the third mode is detected by that a Universal Serial Bus memory (USB memory) is inserted into the Universal Serial Bus port 11. In the third mode the following steps are performed, detecting an external data storage, providing access to the external data storage, and transferring, in response to input from the user interface (8), the set of set-up parameters to the external data storage. The external data storage now comprise a copy of the set of set-up parameters and it could be connected to the second door operator 1 and transfer the set of set-up parameters to the second door operator 1.

The second door operator detects the first mode of receiving the set of set-up parameters. The first mode could according to one aspect be detected by input received from the user interface 8. The input could come from the installing engineer interacting with the user interface 8. In the first mode the following steps are performed in the door operator 1, the external data storage is detected, provide access to the external data storage, and automatically receive, in response to the detecting, the set of set-up parameters from the external data storage. The provided set of set-up parameters is installed in the control unit 9. The control unit 9 is now ready to control the drive unit 7 based on the set of set-up parameters installed in the control unit 9. The second door operator 1 is now installed with an identical set of set-up parameters that are installed in the first door operator 1.

According to this method two or more door operators 1 that are mounted with the same conditions and should have the same set of set-up parameters could be installed in an efficient manner. In an example, when a new building such as a hospital or an airport is built or renovated, it is common that up to 100 door operators 1 should be installed with the same set of set-up parameters. By using the method and door operator 1 according to the above, the time spend to install the door operators 1 could be reduced. By automating parts of the installation, the risk of human errors is also reduced.

According to one aspect, the second mode comprises the step of authenticating the set of set-up parameters. By authenticating the set of set-up parameters the risk of installing the wrong set of set-up parameters is reduced. The risk of that the door operator 1 could be hacked and another set of set-up parameters could be installed by an unauthorised person is reduced.

According to one aspect, the step of storing the set of set-up parameters on a memory unit 13 in the control unit 9 is performed.

According to one aspect, the step of detecting an external data storage comprise the step of detecting a Universal Serial Bus memory's connected to the Universal Serial Bus port 11.

According to one aspect, the door operator 1 comprises a wireless communication device 12 and wherein the step of detecting an external data storage comprises the step of detecting an external wireless communication device connected to an external data storage.

According to one aspect, the set of set-up parameters comprises at least one of the parameters of the geometry of the door set 3, 6, the geometry of the door leaf 2, the speed trajectory of the door leaf 2, a virtual spring, a power assist, a motor lock and a lock release According to one aspect, detecting the first, second or third mode comprises the step of receiving input regarding the first, second or third mode provided via the user interface 8.

According to one aspect, the first mode of receiving the set of set-up parameters could be followed by the second mode of receiving a part of the set of set-up parameters. This could be an efficient way of installing door operators 1 with the need of similar, but not exactly the same, set of set-up parameters as installed in another door operator 1. After that the set of set-up parameters has been installed in the door operator 1, some of the set-up parameters of the set are altered by performing the first mode of receiving the set of set-up parameters for altering some set-up parameters.

According to one aspect, one of the set-up parameters that are set on site is the value of the time that it should take for the door operator 1 to move the door leaf 2 from its open position O to an intermediate position I and from the intermediate position I to the closed position C and from the closed position C to an intermediate position I and from the intermediate position I to the open position O.

According to one aspect, one of the set-up parameters that could be set is the value of the current that should be applied to the drive unit 7.

According to one aspect, one of the set-up parameters that are set is if the door operator 1 should set the first speed trajectory to be based on a value of the time that the first speed trajectory should take for moving the door leaf 2 or on a value of the current that should be applied to the drive unit 7.

The first speed trajectory is initiated, by the door operator 1, in response to a closing or opening command and is performed by the control unit 9 controlling the value of the current applied to the drive unit 7 during the opening or closing.

A closing command is performed in the control unit 1 when an individual, or other obstacle, is no longer detected in the closing path of the door, or after a predetermined time interval has passed from the time of opening the door leaf 2.

According to one aspect, the door operator 1 that is connected to a swing door set 3 is adapted to employ the first speed trajectory and a second speed trajectory when moving the door leaf 2 from the open position O to the closed position C, i.e. closing the door. The first speed trajectory comprises moving the door leaf 2 from the open position O to an intermediate position I and the second speed trajectory comprises moving the door leaf 2 from the intermediate position I to the closed position C. The first speed trajectory is initiated, by the door operator 1, in response to a closing or opening command and is performed by the control unit 9 controlling the value of the current applied to the drive unit 7 during the opening or closing. The second speed trajectory is employed after the first speed trajectory has been employed.

According to an aspect, when a closing command has been received by the door operator 1, the door leaf 2 is moved, using the first speed trajectory, from its open position O at an angle $\alpha$ of preferably 80-110° to the closed position C. The closed position C equals the completely closed position, i.e. a 0° angle.

According to an aspect, when a closing command has been received by the door operator 1, the door leaf 2 is moved, using the first speed trajectory, from its open position O at an angle $\alpha$ of preferably 80-110°, to an intermediate position I at an angle $\beta$ of preferably 10°. Thereafter, the door leaf 2 is moved, using a second speed trajectory, from its intermediate position I to the closed position C. The closed position C equals the completely closed position, i.e. a 0° angle.

According to an aspect, the door set may comprise one or two door leafs 2, and the door set 3, 6 may be of the swing door type or the sliding door type. When having two door leafs 2, the first and second predetermined speed trajectories are preferably initiated simultaneously for both door leafs 2*a*, 2*b*, even though they may be initiated with some delay.

The control unit 9 is configured to control the drive unit 7 such that the door operator 1 employ the first speed trajectory to the door leaf 2. The shape and size of the first speed trajectory are dependent on a number of the set-up parameters stored in the control unit 9 or in a memory connected to the control unit 9.

According to one aspect, the set of set-up parameters comprise one or more of the time for moving the door leaf 2 from the closed position C to the open position O, the time for moving the door leaf 2 from the open position O to the closed position C, the time for moving the door leaf 2 from the closed position C to the intermediate position I, the time for moving the door leaf 2 from the open position O to the intermediate position I, the time for moving the door leaf 2 from the intermediate position I to the closed position C, the time for moving the door leaf 2 from the intermediate position I to the open position O, the value of the current applied to the drive unit 7 when employing the first speed trajectory, the value of the current applied to the drive unit 7 during different periods when employing the first speed trajectory, the period of the opening and closing that the drive unit 7 should be accelerated, the period of the opening and closing that the drive unit 7 should be braked, how much the motor should be accelerated and/or how much the motor should be braked.

According to an aspect, a system of door operators (1) could comprise one or more door operators (1) adapted to detect a first, second and third mode and one or more door operators (1) adapted to only detect the first and/or second mode. By such a system the complexity of some of the door operators (1) could be reduced. By having at least one door operator (1) having all the three modes, the other door operators (1) only need to copy the set of set-up parameters from that door operator (1) in the first mode.

By using the door operator and the method according to the above, the time spend to install the set-up parameters, i.e. parameters that are dependent on the surroundings and position of a door operator, could be reduced. By automating parts of the installation of the set-up parameters, the risk of human errors is also reduced. Further, by the door operator being able to interact with the external data storage, there is no need of an external computer to install the set-up parameters.

The person skilled in the art realizes that the present invention by no means is limited to the preferred embodiments described above. On the contrary, many modifications and variations are possible within the scope of the appended claims. For example, a sliding door set may comprise of more than two sliding door leafs, arranged in the same way as discussed above.

The invention claimed is:

1. A door operator for operating a door leaf of a door set, comprising a drive unit and a control unit connected with a user interface, wherein the control unit comprises a first mode for receiving a set of set-up parameters, wherein, in response to a signal from the user interface, the control unit enters the first mode and wherein, in the first mode the control unit detects an external data storage, provides access to the external data storage, and automatically receives the set of set-up parameters from the external data storage, installs the set of set-up parameters in the control unit and controls the drive unit based on the set of set-up parameters installed in the control unit.

2. The door operator according to claim 1, wherein the control unit further comprises a second mode for receiving the set of set-up parameters and in the second mode the control unit receives the set of set-up parameters provided via the user interface.

3. The door operator according to claim 1, wherein the control unit is connected to the drive unit, wherein the drive unit comprises a motor, wherein the motor is connected to the door leaf and, in response to a signal from the control unit, the drive unite moves the door leaf between an open and a closed position.

4. The door operator according to claim 1, wherein the set of set-up parameters comprises parameters that are dependent on the surroundings of the door leaf.

5. The door operator according to claim 1, wherein the set of set-up parameters comprises at least one of a geometry of the door set, a geometry of the door leaf, a speed trajectory of the door leaf, a virtual spring, a power assist, a motor lock and a lock release.

6. The door operator according to claim 1, wherein the control unit comprise a memory unit and wherein the memory unit is configured to store said set of set-up parameters.

7. The door operator according to claim 1, wherein in the control unit is configured to authenticate the set of set-up parameters.

8. The door operator according to claim 1, further comprising a Universal Serial Bus port, wherein the Universal Serial Bus port is connected to the control unit and adapted to be connected to an external Universal Serial Bus memory.

9. The door operator according to claim 1, further comprising a wireless communication device, wherein the wireless communication device is connected to the control unit and adapted to establish a wireless communication with an external wireless communication device.

10. The door operator according to claim 1, wherein the control unit further comprises a third mode for transferring the set of set-up parameters, wherein in the third mode the control unit:

detects the external data storage, provides access to the external data storage, and transfers, in response to input from the user interface, the set of set-up parameters to the external data storage.

11. The door operator according to claim 1, wherein the user interface comprises a touch screen, a potentiometer, a dip switch or a set of buttons.

12. A method for set-up of a door operator for operating a door leaf of a door set, the door operator comprises a control unit, a user interface and a drive unit, wherein the control unit is connected to the drive unit and the user interface, and the drive unit comprises a motor and is adapted to be connected to the door leaf and to move the door leaf between an open and a closed position, wherein the method comprises the steps of detecting a first mode of receiving a set of set-up parameters, in the first mode detecting an external data storage, providing access to the external data storage, and automatically receiving, in response to the detecting, the set of set-up parameters from the external data storage, installing the set of set-up parameters in the control unit and controlling the drive unit based on the set of set-up parameters installed in the control unit.

13. The method according to claim 12, further comprising the step of detecting a second mode of receiving the set of set-up parameters and in the second mode receiving the set of set-up parameters provided via the user interface.

14. The method according to claim 13, wherein the method comprises the step of detecting a third mode of transferring the set of set-up parameters: in the third mode:

detecting the external data storage, providing access to the external data storage, and transferring, in response to input from the user interface, the set of set-up parameters to the external data storage.

15. The method according to claim 14, wherein detecting the first, second or third mode comprise the step of receiving input regarding the first, second or third mode provided via the user interface.

16. The method according to claim 12, wherein the second mode further comprises the step of authenticating the set of set-up parameters.

17. The method according to claim 12, further comprising the step of storing the set of set-up parameters on a memory unit in the control unit.

18. The method according to claim 12, wherein the door operator comprises a Universal Serial Bus port connected to the control unit, and wherein the step of detecting an external data storage comprises a step of detecting a Universal Serial Bus memory connected to the Universal Serial Bus port.

19. The method according to claim 12, wherein the door operator comprises a wireless communication device and wherein the step of detecting an external data storage comprises the step of detecting an external wireless communication device connected to an external data storage.

20. The method according to claim 12, wherein the set of set-up parameters comprises at least one a geometry of the door set, a geometry of the door leaf, a speed trajectory of the door leaf, a virtual spring, a power assist, a motor lock and a lock release.

* * * * *